United States Patent [19]

Mertz et al.

[11] Patent Number: 4,943,691

[45] Date of Patent: Jul. 24, 1990

[54] LOW-VOLTAGE LIMITING CIRCUIT BREAKER WITH LEAKTIGHT EXTINGUISHING CHAMBER

[75] Inventors: Jean-Luc Mertz, Grenoble; Hubert Guerin, Meylan; Michel Perrot, Quaix en Chartreuse; Patrick De Robertis, Vizille, all of France

[73] Assignee: Merlin Gerin, France

[21] Appl. No.: 364,102

[22] Filed: Jun. 12, 1989

[30] Foreign Application Priority Data

Jun. 10, 1988 [FR] France ..... 88 07891

[51] Int. Cl.[5] ..... H01H 33/06

[52] U.S. Cl. ..... 200/151; 200/148 R; 200/148 B

[58] Field of Search ..... 200/151, 148 R

[56] References Cited

U.S. PATENT DOCUMENTS 4,534,263 8/1985 Heyne et al. ..... 200/151
4,563,556 1/1986 Goldstein ..... 200/151
4,677,266 6/1987 Belbel et al. ..... 200/148 R
4,700,030 10/1987 Belbel et al. ..... 200/151

FOREIGN PATENT DOCUMENTS 0185577 6/1986 European Pat. Off. .
1238660 7/1960 France .

*Primary Examiner*—Robert S. Macon
*Attorney, Agent, or Firm*—Arnold, White & Durkee

[57] ABSTRACT

A current limiter comprises an extinguishing chamber 16 of small volume, in which there are housed a pair of contacts 28, 30 and an insulating shield 40, capable of moving to an active position inserted between the contacts 28, 30, and of subdividing the chamber 16 into two parts each of which contains one of the contacts 28, 30. The movement of the insulating shield 40 to the inserted position between the contacts 28, 30 is favored by the action of a piston 48 subjected to the pressure prevailing in the extinguishing chamber 16.

10 Claims, 4 Drawing Sheets

LOW-VOLTAGE LIMITING CIRCUIT BREAKER WITH LEAKTIGHT EXTINGUISHING CHAMBER

BACKGROUND OF THE INVENTION

The invention relates to a current limiting device having a leaktight extinguishing chamber in which there are housed a pair of separable contacts and a movable insulating shield capable of occupying an inactive position when said contacts are closed, and of being moved to an active position subdividing said chamber into two independent parts each of which contains one of said contacts when the latter are separated.

Protection of electrical installations requires limiting devices or circuit breakers having higher and higher breaking capacities the cost and dimensions of which are becoming prohibitive. In a state-of-the-art limiting device of the kind mentioned, the movable insulating shield causes separation of the contacts and shearing of the arc drawn between the contacts with a leaktight partition interposed between the two open contacts. The breaking capacity of a device of this kind, designed to protect the electrical installation of a submarine, is relatively limited and the object of the present invention is to perfect such a device while preserving the advantage of small overall dimensions.

SUMMARY OF THE INVENTION

The current limiting device according to the invention is characterized in that the volume of said chamber is limited to the dimensions of said contacts to bring about a large high-speed pressure increase due to the action of an arc drawn when said contacts separate and that said shield is securedly united to a piston subjected to the action of said pressure to urge the shield to the active position when an arc occurs drawn between the contacts.

By the combined action of a high-speed pressure increase in the extinguishing chamber and the use of this pressure to move the insulating shield at high speed to its active position, the breaking capacity and the current limiting effect can be notably increased. The case of the limiting device must of course be designed to withstand the high pressures occurring in the extinguishing chamber when a high-intensity current, notably a short-circuit current, is interrupted. The shield is advantageously a sliding plate which interposes itself between the contacts to insulate them from one another and a piston, subjected to the pressure prevailing in the extinguishing chamber, accomplishes or contributes to the high-speed movement of the insulating shield. The extinguishing chamber is preferably flattened, forming a slit of small width, close to that of the contacts housed in this chamber, the latter moving in the direction of the slit. The limiting device may comprise a single movable contact operating in conjunction with a stationary contact, but in a preferred embodiment of the invention, both the contacts are movable and arranged symmetrically from the insulating shield. These contacts are separable by the action of electrodynamic repulsion forces due to the current flowing in opposite directions in the two contacts arranged face to face, in a manner well-known to those specialized in the art. The contacts are preferably pivotally mounted on parallel spindles extending perpendicularly to the slit constituting the extinguishing chamber. Contact pressure springs bias the contacts to the closed position.

The pressure increase can be enhanced by the presence of gas-producing materials in the vicinity of the arc, one of the gas-producing elements for example being able to be the movable shield or a part of the chamber wall located in the vicinity of these contacts.

The limiting device according to the invention can be used as a limiter electrically connected in series with a circuit breaker to limit the value of short-circuit currents, but it can also be used in a limiting circuit breaker. In this case, the movable shield is extended by an operating rod which operates in conjunction with an operating mechanism located outside the extinguishing chamber. This mechanism can comprise a standard electromagnetic and/or thermal trip device, which, when a short-circuit or an overload occurs, causes the shield to move in the separation direction of the contacts, the wedge-shaped shield causing this separation and the formation of an arc. As soon as the arc forms and the corresponding pressure increase occurs inside the chamber, the displacement movement of the shield is amplified by the piston effect due to the pressure in the extinguishing chamber.

The pressure inside the extinguishing chamber may reach several hundred bars and this pressure varies according to the arcing current intensity, and with the speed of movement of the shield which both contribute to the arc limiting and extinguishing effect.

BRIEF DESCRIPTION OF THE DRAWINGS

Other advantages and features will become more clearly apparent from the following description of an illustrative embodiment of the invention, given as a non-restrictive example only and represented in the accompanying drawings, in which.

DESCRIPTION OF THE PREFERRED EMBODIMENT

Figure 1:
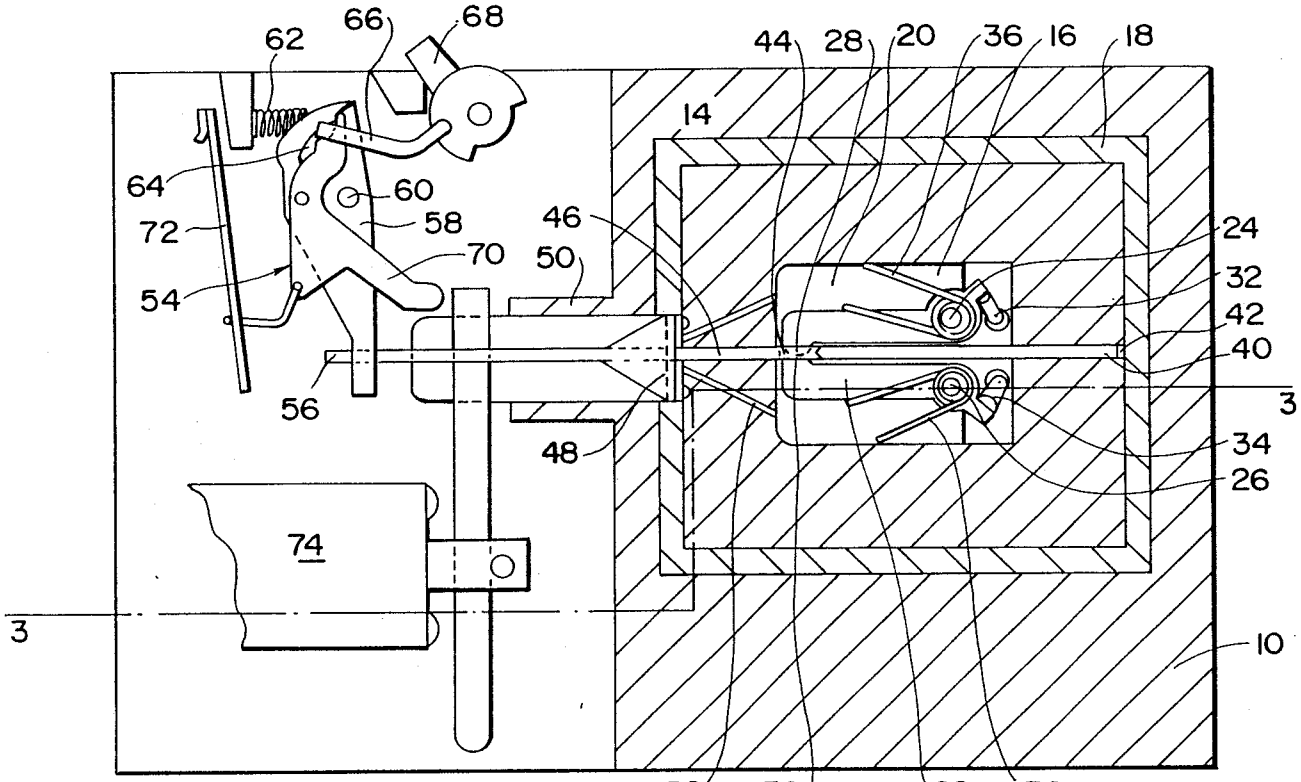
FIG. 1 is a schematic axial sectional view of a limiting circuit breaker according to the invention represented in the closed position.

In the figures, a case or block of insulating material is made up of a base 10 and a cover 12, assembled according to a joint face 14. A flattened recess 16 in the form of a slit is arranged in the block 10, 12 parallel to and at the level of the joint face 14 to constitute a leaktight chamber surrounded by a sealing joint 18 formed by an assembly of a rib and groove respectively arranged in the base 10 and the cover 12, and surrounding the chamber 16. In the chamber 16 there are housed a pair of contact arms 20, 22 in the form of knife-blades, articulated at one of their ends on a spindle 24, 26, and bearing at the opposite end a contact 28, 30. Connecting braids 32, 34 are soldered to the ends of the contact arms 20, 22 near to the spindles 24, 26, and in the closed position of the contacts 28, 30, the contact arms 20, 22 extend parallel having flowing through them currents of opposing directions capable of generating electrodynamic repulsion forces, urging the contacts 28, 30 to the open position. Return springs 36, 38 act on the contact arms 20, 22 to maintain the contacts 28, 30 in the closed position, represented in FIG. 1. An insulating shield 40 in the form of a plate extending perpendicularly to the joint face 14, is slidingly mounted being guided by grooves 42 arranged at the edge of the chamber 16. The shield 40 is interposed between the contact arms 20, 22 and in the closed position of the contacts 28, 30, the latter pass through an opening 44 arranged in the shield 40. An operating rod 46 forms an extension of the shield 40 and supports a piston 48 slidingly mounted in a cylinder 50, securedly united to the block 12, 14. The chamber 16 communicates with the cylinder by ducts 52 to allow the gases to escape from the chamber 16 to the piston 48, which is pushed by the pressure to the left in FIG. 1, moving the shield 40 to an active position interposed between the contacts 28, 30. The piston 48 seals the cylinder 50 with a leaktight material, preventing any communication of the chamber 16 with the ambient environment. The operating rod 46 is extended beyond the piston 48, and its end 56 operates in conjunction with a mechanism designated by the general reference 54. The end 56 operates in conjunction with a plate 58 pivotally mounted on a fixed spindle 60 and urged in the displacement position of the end 56 to the left in FIG. 1 by a spring 62. The plate 58 comprises an aperture 64 in which the end of a rod 66 is capable of moving, the opposite end of which cooperates with a pivoting manual operating handle 68. A latch 70 articulated on the plate 58 locks the rod 66 in the active position, and is capable of being unlocked by the action of a bimetal strip 72 or an electro-magnetic trip device 74, to release the latching formed by the rod 66 and the aperture 64 and to allow the plate 58 to pivot due to the action of the spring 62, in the insertion direction of the shield 40 between the contacts 28, 30. An operating mechanism 54 of this kind is well-known to those specialized in the art, and it is sufficient to recall that pivoting of the handle 68 causes the shield 40 to be moved in one direction or the other. An overload detected by the bimetal strip or a short-circuit detected by the electromagnetic trip device 74, causes clockwise pivoting of the latch 70, and releases the latching constituted by the rod 66 and the aperture 64, to enable the shield 40 to move to the open position of the contacts 28, 30 due to the action of the spring 62.

Figure 2:
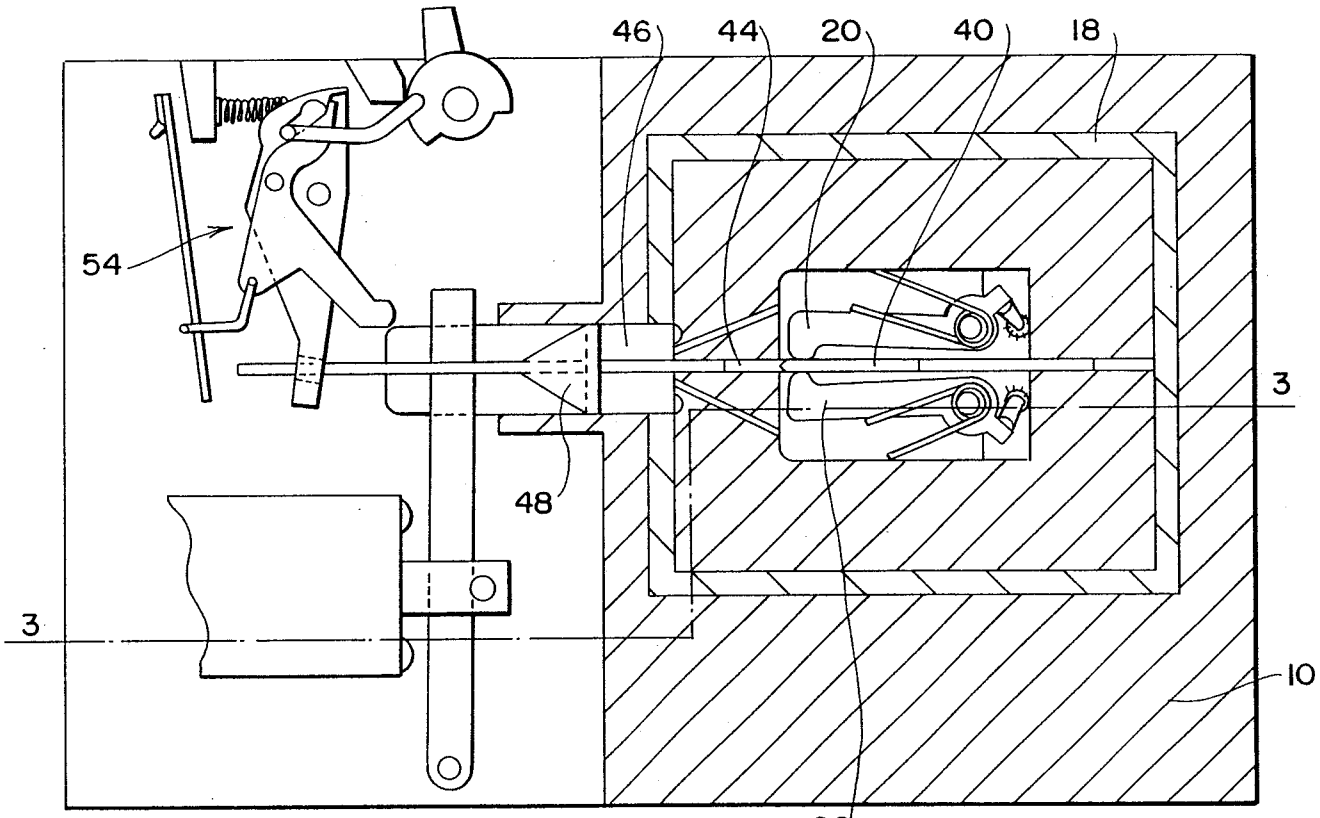
FIG. 2 is an identical view to that of FIG. 1, showing the circuit breaker in the course of opening.
Figure 3:
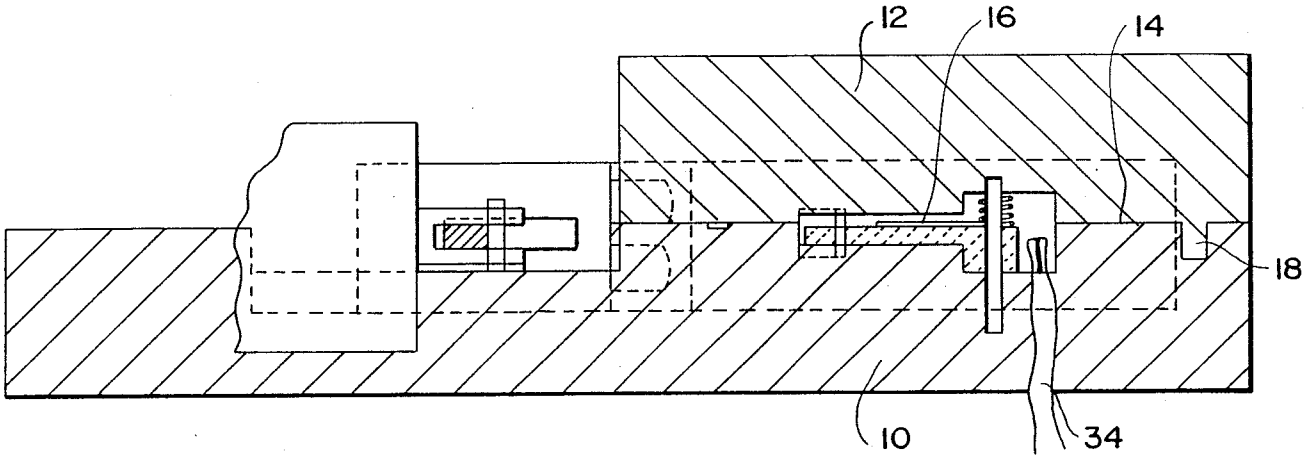
FIG. 3 is a cross-section along the line III—III of FIG. 1.

The recess 16 constitutes an extinguishing chamber in the shape of a parallelipipedic rectangle of small volume corresponding appreciably to the dimensions of the contact arms 20, 22. In FIG. 3, it can be seen that the width of the slit formed by the recess 16 is only slightly greater than the thickness of the knife-blade contact arms 20, 22, only the rear of the chamber in which the connecting braids 32, 34 and the shafts 24, 26 are disposed being of greater width. Referring to FIG. 1, it can be seen that the depth of the slit constituting the chamber 16 is adapted to the amplitude of movement of the contact arms 20, 22. The small volume of the extinguishing chamber 16 enables a pressure increase to occur quickly due to the action of an arc drawn between the separated contacts 28, 30. The insulating shield 40 is advantageously made of a gas-producing material favoring a pressure increase inside the chamber 16 due to the action of the arc, other parts of the chamber 16 being possibly able to be made of gas-producing material. The assembly constitutes a low-voltage current limiting circuit breaker operation of which is as follows:

In the closed position represented in FIG. 1, the contacts 28, 30 are closed and pass through the orifice 44 of the shield 40. This shield 40 does not partition the extinguishing chamber 16 into two parts, and a uniform pressure prevails in this chamber 16. When a short-circuit or overload current occurs detected by the electromagnetic trip device 74, or by the bimetal strip 72, the latter act on the latch 70 to release the mechanism 54 and actuate the rod 46 by the spring 62 which moves the sliding shield 40 to the left in FIG. 1. The edge of the wedge-shaped orifice 44 causes the contacts 28, 30 to separate with formation of an arc. The gas present in the extinguishing chamber 16 is heated by the action of the arc and the corresponding pressure increase in the sealed chamber 16 is transmitted to the cylinder 50 and to the piston 48 which is pushed to the left in FIG. 1 to amplify the sliding of the shield 40 to the active insertion position between the contacts 28, 30. In the open position of the circuit breaker, the insulating shield 40 subdivides the extinguishing chamber 16 into two leaktight parts, each containing one of the contacts 20, 28; 22, 30. The large high-speed pressure increase inside the extinguishing chamber 16 favors high-speed arc extinction, the high-speed movement of the shield 40 and the shearing of the arc by the shield 40 contributing to this high-speed extinction. The pressure increase and the arc shearing speed depend directly on the value of the current interrupted. After cooling and decrease of the pressure in the extinguishing chamber 16, the circuit breaker can be reclosed in the usual way by pivoting of the handle 68. The electromagnetic trip device 74 acts directly as an extractor on the rod 46 to increase the speed of displacement of the shield 40 in the opening direction. Separation of the contacts is enhanced by the electrodynamic repulsion forces acting on the contact arms 20, 22. The embodiment illustrated by FIGS. 1 to 3 comprises a symmetrical assembly, the insulating shield 40 subdividing the chamber 16 into two equal parts, but it is clear that one of the contacts may be arranged as a stationary contact, only the other contact being a pivoting or sliding contact.

Figure 4:
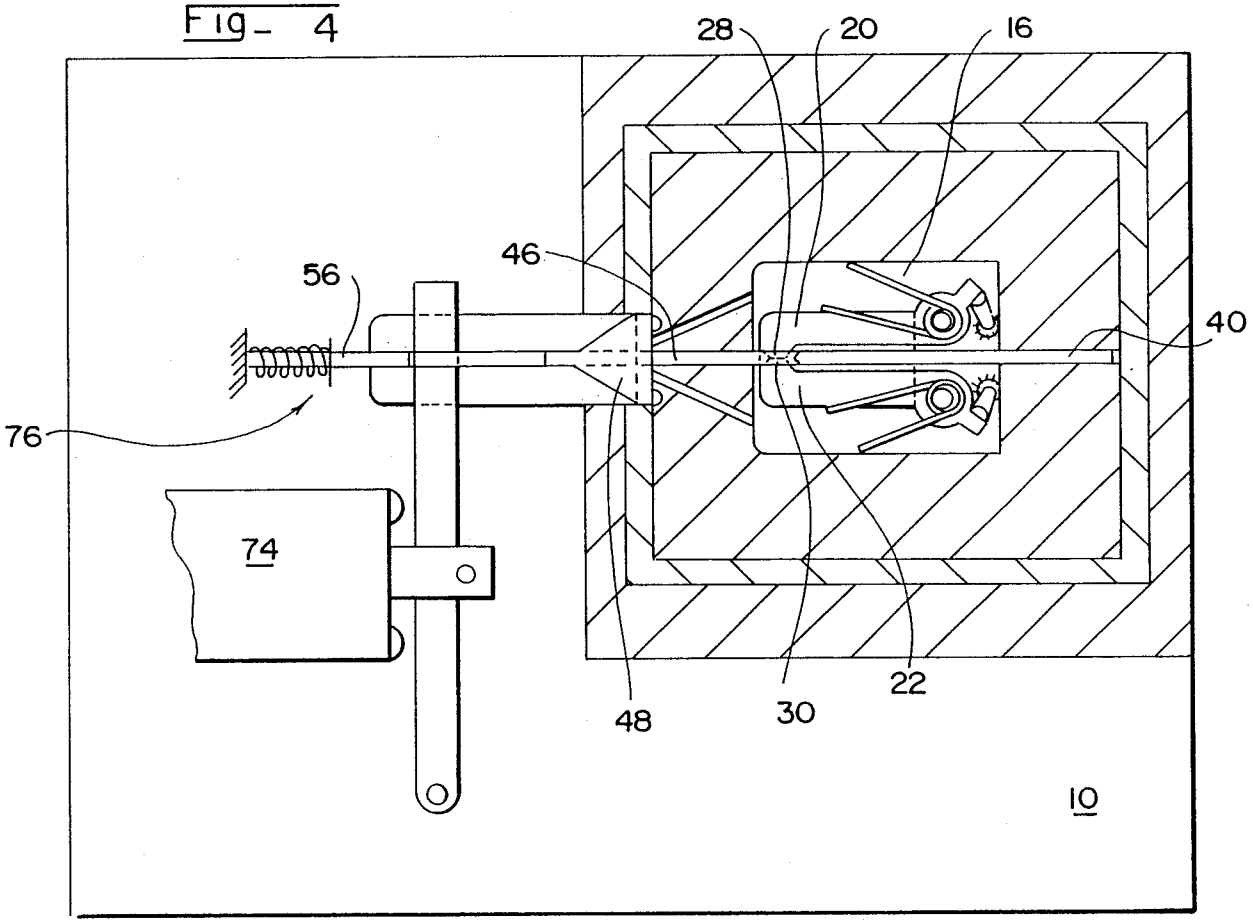
FIG. 4 is a similar view to that of FIG. 1, illustrating a limiting device according to the invention.

In FIG. 4, which represents an alternative embodiment, the same reference numbers are used to designate similar or identical parts to those in FIG. 1. The extinguishing chamber 16 and the contact arms 20, 22 with the insulating shield 40 are absolutely identical to those described above, only the actuating mode of the operating rod 46 supporting the piston 48 having been modified by eliminating the mechanism 54, only the electromagnetic trip device 74 of which is kept. The device represented in FIG. 4 operates as a limiter in the following manner:

When a short-circuit occurs detected by the electromagnetic trip device 74, the latter acts on the end 56 of the operating rod 46 to move the latter to the left in FIG. 4 with insertion of the insulating shield 40 between the contacts 28, 30 which separate drawing an arc. Breaking takes place in the manner described above by a pressure increase in the extinguishing chamber 16 and by shearing of the arc by the shield 40. As soon as the arc has been extinguished and the pressure in the extinguishing chamber 16 has decreased, the movable assembly is returned to the normal closed position by an elastic device 76, schematically represented by a spring acting on the end 56 of the rod 46.

Other operating modes of the limiting device according to the invention are conceivable, for example by using the electrodynamic repulsion force of the contact arms 20, 22. Such an embodiment comprises an insulating slide 40 urged to the active insertion position between the contacts 28, 30 by a spring which is not shown, the shield being held in the retracted inactive position by the contact arms 20, 22. The electromagnetic trip device 74 is eliminated, opening being controlled by the movement of the contact arms 20, 22 due to the action of the electrodynamic repulsion forces, when the current flowing in these contact arms 20, 22 exceeds a preset pick-up level.

As soon as the contacts 28, 30 have separated, the shield moves to the left in the figures to an active position inserted between the contacts 28, 30 due to the action of the spring and of the piston 48 subjected to the pressure prevailing in the chamber 16. This movement can also result solely from the piston effect due to the pressure increase in the chamber 16, in which case the shield 40 can be subjected to the effect of a return spring such as the one 76 illustrated by FIG. 4. The base 10 and the cover 12 must of course be made of a material capable of withstanding the high pressures generated in the extinguishing chamber 16, this material being able to be metallic or possibly totally or partially ceramics. The assembly constitutes a particularly compact current limiting device or a limiting circuit breaker capable of breaking high-intensity low-voltage currents.

We claim:

1. A limiting device of an electric current, comprising:

a leaktight extinguishing chamber, a pair of separable contacts housed in said extinguishing chamber, an insulating shield slidingly mounted in said extinguishing chamber between two end positions, one active position in which said shield is inserted between said separable contacts in open position and subdividing said extinguishing chamber into two independent parts each of which containing one of said contacts, and the other inactive end position of retreat of the shield allowing the closing of said contacts and a communication between said two parts of the extinguishing chamber, a piston securedly united to said shield having a face subjected to the action of pressure in said extinguishing chamber to move the shield to the active position when said pressure increases due to the action of an arc drawn when said contacts separate, the volume of said extinguishing chamber substantially corresponding to the dimensions of said contacts in separated position in order to reduce to a minimum the gas volume contained in said chamber and to obtain a fast pressure increase of this gas due to the arc action.

2. Limiting device according to claim 1, wherein said shield is a sliding plate interposing itself between the contacts in the active subdividing position of the chamber.

3. Limiting device according to claim 2, wherein said piston is slidingly mounted in a cylinder in communication with said extinguishing chamber.

4. Limiting device according to claim 1, having a knife-shaped contact and wherein the extinguishing chamber is in the form of a slit in which said knife-shaped contact moves, the width of the slit being slightly greater than that of said contact.

5. Limiting device according to claim 1, wherein said pair of contacts is arranged to generate an electrodynamic force repelling and separating the contacts, when the current flowing in the contacts exceeds a preset pick-up level, to draw an arc and move the shield to the active position by the action of the pressure generated in the extinguishing chamber.

6. Limiting device according to claim 5, wherein said pair of contacts is constituted by two elongated contacts extending parallel and electrically connected in series to have flowing through them currents of opposing directions generating an electrodynamic force repelling the contacts.

7. Limiting device according to claim 6, having a spindle on which the contact is pivotally mounted at one of its ends and a spring biasing each contact to the closed position.

8. Limiting device according to claim 1, wherein said shield is made of a gas-producing material.

9. A low-voltage circuit breaker equipped with a limiting device according to claim 1, wherein said insulating shield comprises an operating rod and an operating mechanism capable of moving the shield in the insertion direction between the contacts causing separation of the contacts and formation of an arc.

10. Circuit breaker according to claim 9, wherein said mechanism comprises an electromagnetic and/or thermal trip device and a manual operating handle.

* * * * *